United States Patent [19]

Wilson

[11] Patent Number: 4,964,518

[45] Date of Patent: Oct. 23, 1990

[54] RECEPTACLE FOR COLLECTING AND BUNDLING NEWSPAPERS

[76] Inventor: William Wilson, 814 Jackson Ave., S. Plainfield, N.J. 07080

[21] Appl. No.: 485,487

[22] Filed: Feb. 28, 1990

[51] Int. Cl.[5] ..... A47F 7/00

[52] U.S. Cl. ..... 211/50; 248/146; 211/71; 100/34

[58] Field of Search ..... 211/50, 72, 126, 71, 211/49.1; 53/390, 592; 248/146, 152; 100/34

[56] References Cited

U.S. PATENT DOCUMENTS

| | | | |
|---|---|---|---|
| D. 228,052 | 8/1973 | Howard . | |
| D. 249,617 | 9/1978 | Bozicnik | 100/34 |
| D. 284,916 | 8/1986 | Marks . | |
| 2,934,210 | 4/1960 | Jordan . | |
| 3,038,403 | 6/1962 | Orelind | 100/34 |
| 3,171,347 | 3/1965 | Elrod | 100/34 |
| 4,167,903 | 9/1979 | Lasher | 100/34 |
| 4,298,126 | 11/1981 | Filipowicz | 211/50 |
| 4,603,542 | 8/1986 | Reiter et al. | 53/592 X |

*Primary Examiner*—Ramon S. Britts
*Assistant Examiner*—Sarah A. Lechok
*Attorney, Agent, or Firm*—T. M. Gernstein

[57] ABSTRACT

A receptacle is open topped and includes a bottom having paths defined thereacross. The receptacle includes jogging board-type elements to organize the loose newspapers. Twine can be placed in the paths and wrapped about the newspapers to tie the papers into a bundle. A shuttle element can also be used to pull twine through the paths after newspapers have been placed in the receptacle.

3 Claims, 3 Drawing Sheets

RECEPTACLE FOR COLLECTING AND BUNDLING NEWSPAPERS

TECHNICAL FIELD OF THE INVENTION

The present invention relates to the general art of receptacles, and to the particular field of open-topped collection receptacles.

BACKGROUND OF THE INVENTION

Recycling and separation of trash for special handling has become a necessity in recent years. One phase of this recycling has been newspaper recycling.

In newspaper recycling, a person separates newspapers from the rest of their trash, and deposits such newspapers at a special drop-off location.

The drop-off locations are generally operated by personnel who stack the papers and separate the papers even further (i.e., magazines are separated from the remainder of the papers). Many drop-off locations have rules requiring the users to stack and bundle their own newpapers.

Stacking and bundling a multiplicity of newspapers can be an onerous task, and it has been given as the main reason for not using a voluntary newspaper recycling process. Gathering and stacking loose newspapers together is an arduous task in itself. However, if the gathered and stacked papers must also be bound, the task is made even more difficult.

While there are known devices which can be used to collect loose newspapers, these known devices do not permit the collected papers to be tied into a bundle in an easy and expeditious manner, especially after the papers have been gathered and stacked in the collection device.

Therefore, there is a need for a newspaper collection and storing receptacle which permits easy storing and collection of loose newspapers, yet which also permits those collected and stored newspapers to be bound in an easy and expeditious manner, even after the papers have been collected and stacked.

OBJECTS OF THE INVENTION

It is a main object of the present invention is to provide a newspaper collection and storing receptacle which permits easy storing and collection of loose newspapers.

It is another object of the present invention to provide a newspaper collection and storing receptacle which permits easy storing and collection of loose newspapers, yet which also permits those collected and stored newspapers to be bound in an easy and expeditious manner.

It is another object of the present invention to provide a newpaper collection and storing receptacle which permits easy storing and collection of loose newspapers, yet which also permits those collected and stored newpapers to be bound in an easy and expeditious manner, even after the papers have been collected and stacked.

SUMMARY OF THE INVENTION

These, and other, objects are achieved by an open-topped receptacle in which loose newspapers are collected. The receptacle has jogging board-like edges for aligning the corners of the collected newspapers and arranging these collected newspapers into a neat stack. The receptacle also has a raised floor having orthogonally arranged paths defined thereacross. Twine can be placed in the paths and drawing around the stacked newspapers to secure these papers into a tied bundle. A shuttle can also be included for assisting a user force the twine through the paths after the newspapers have been collected and stacked in the receptacle.

In this manner, the collection and storing of loose newspapers is easy, yet the securing of such newspapers into a tied bundle is also easy and expeditious, even if the person effecting the bundling process forgets about tieing the bundle until after the newspapers have been collected and stacked in the receptacle.

BRIEF DESCRIPTION OF THE DRAWING FIGURES

DETAILED DESCRIPTION OF THE PREFERRED EMBODIMENT OF THE INVENTION

Figure 1:
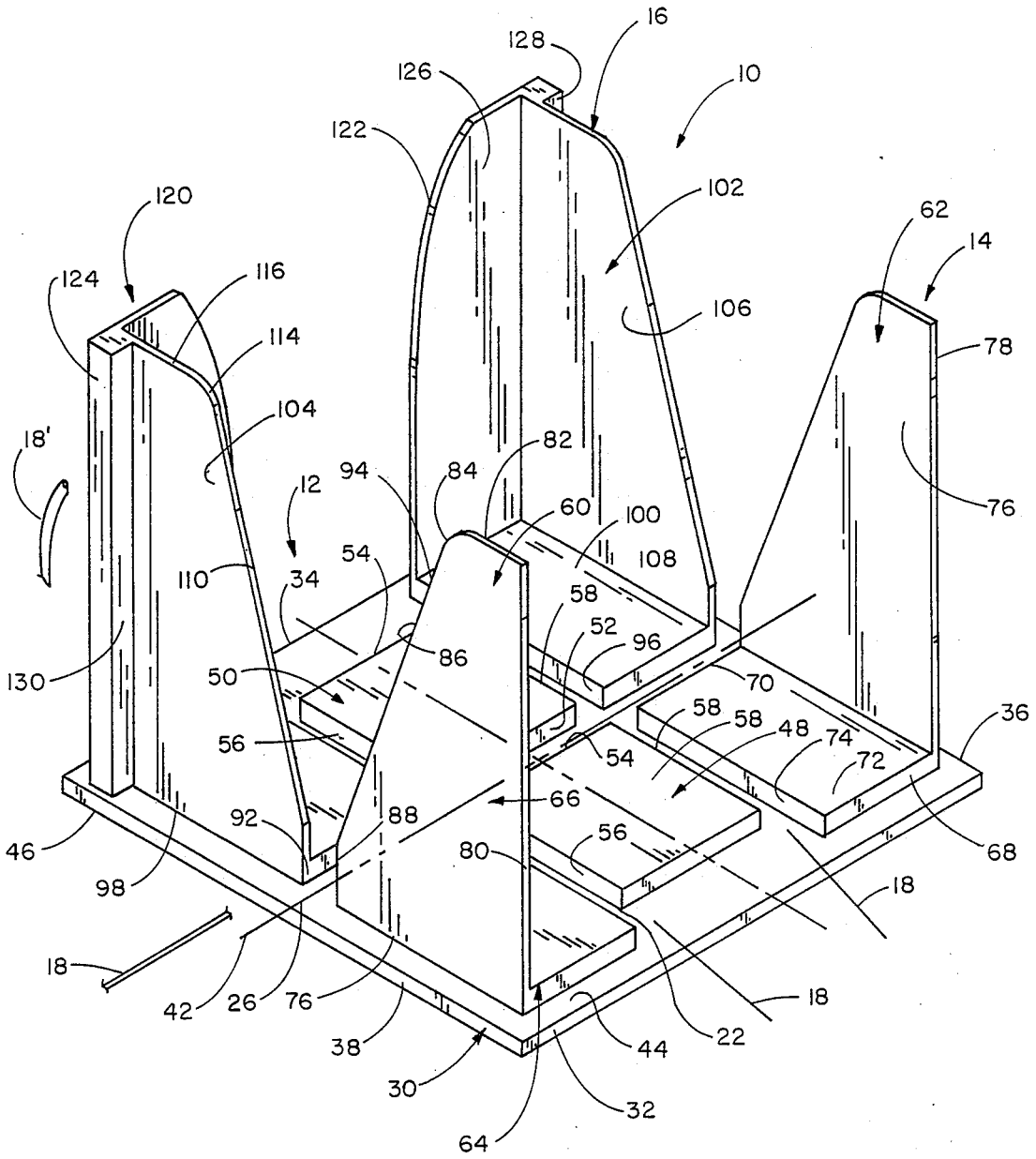
FIG. 1 is a perspective view of a first form of the newspaper collection and bundling receptacle of the present invention.

Shown in FIG. 1 is a receptacle 10 in which loose newspapers are collected and arranged so that a neat bundle can be formed. The receptacle 10 includes a double bottom 12 and jogging board-type front side elements 14 and rear side 16 that extend upwardly from the double bottom 12 to form an open-topped container. As loose newspapers are placed into the receptacle 10, they are automatically oriented so that all of the corners are aligned and the papers form a neat stack. Twine 18 is placed in orthogonally arranged paths 20 and 22 defined across the double bottom to be wrapped about the loose newspapers to the tie such newspapers into a bundle. Ribbon, indicated by reference numeral 18', is wider than the twine 18, and can be wrapped about the bundle to further secure that bundle. Due to the shape of the receptacle sides, the ribbon can be secured around a bundle of newspapers that is still in the receptacle, yet the secured bundle can still be removed from the receptacle. The ribbon will slip off of the sides of the container yet still be tight enough to further secure the bundle.

More specifically, the receptacle 10 includes a base element 30 that includes a front end 32, a rear end 34, a left side 36 and a right side 38 with reference to the orientation of the receptacle shown in FIG. 1. The base element includes a longitudinal centerline 40 extending between the front end and the rear end, and a transverse centerline 42 extending between the right and left sides of the base element. The base element also includes a planar top surface 44 and a bottom surface 46, with a thickness dimension measured between the top and bottom surfaces. In the preferred form, the base element 12 is rectangular in peripheral shape, and can be formed of any suitable material, such as plastic, metal or the like.

The double bottom further includes a front support pad 48 located between the transverse centerline 42 and the front end 32 of the base element, and a rear support pad 50 located between the transverse centerline 42 and the rear end 34. The support pads are identical, and each includes a front edge 52 and a rear edge 54 with right and left side edges 56 and 58, respectively, connecting the front and rear edges together to form a rectangular peripheral shape. The front edges and the rear edges are parallel with each other and are parallel to the front and rear ends 32 and 34, respectively, of the base element. The right and left side edges of the support pads are also parallel to the right and left sides 38 and 36, respectively, of the bottom element and are collinear with each other. The rear edge 54 of the front support pad is spaced from and parallel to the front edge 52 of the rear support pad, and the transverse centerline is located midway between these two edges.

Each support pad also includes a planar top surface 58 and a bottom surface that is fixedly attached to the base element top surface 44. A thickness dimension for each support pad is defined between the top surface 58 and the base element top surface, and the support pad top surfaces are coplanar with each other.

The front side elements 14 are identical to each other and include a right side element 60 on the base element right side and a left side element 62 on the base left side. The side elements are monolithic to provide a sturdy support for newspapers stored in the receptacle, and are L-shaped to have a short leg 64 and a long leg 66.

The short leg of each element is affixed to the base element top surface, and has a front edge 68 located adjacent to but spaced from the base element front end and which is parallel to that base element front end, and a rear edge 70 which is parallel to the front edge 68 which is adjacent to and spaced from the transverse centerline 42. The front edges 68 are collinear with each other and are spaced from and parallel to the front edge 52 of the front support pad. The rear edges 70 are collinear with each other and with the rear edge 54 to define the transverse path 20 across the base element. The short legs have a planar top surface 72 and a bottom surface that is fixedly mounted on the base element top surface 72 and the top surface of the base element. The planar top surfaces 72 are coplanar with each other and with the planar top surfaces 58 of the support pads.

The short legs also include an inside edge 74 that is spaced from and parallel to the corresponding edges of the support pads. An outside edge 76 of each short leg is spaced from and parallel to the corresponding side of the base element.

The long leg 66 of each element includes an inside surface 76 and an outside surface 78 and extend upwardly from the base element top surface at a right angle thereto. Each long leg includes a bottom edge which abuts the base element top surface, and a front edge 80 that is located adjacent to the base element front end 32. A top edge 82 extends rearwardly from the front edge and is parallel to the base element top surface. A rounded corner 84 connects the top edge 82 to a first portion 86 of a rear edge of the long leg, with that first portion extending from the top edge downwardly at a skewed angle towards the base element top surface. A second portion 88 of the rear edge extends downwardly from the first portion to the base element top surface at a right angle to that top surface. The rounded corners of the long legs facilitates placing the twine in the paths.

The rear side elements 16 are T-shaped and are also monolithic for strength purposes. The elements are identical, and each includes a short leg 90 fixed to the base element top surface. Each short leg is preferably rectangular and includes a front edge 92 located adjacent to and spaced from the transverse centerline 42 and a rear edge 94 spaced from and parallel to the base element rear end 34. The front edges 92 are collinear with each other and with the front edge 52 of the rear support pad to define the path 20. The legs 90 also include an inside edge 96 an an outside edge 98. The inside edges 96 are parallel with each other and with the edges 56 and 58 respectively, and are collinear with the edges 74 to define the paths 22. Each short leg 90 includes a bottom surface fixed to the base element top surface, and has a top surface 100 that is coplanar with the top surfaces 58 and 72.

The coplanar nature of the top surfaces provides a secure support for newspapers being stored in the receptacle 10, yet spaces those papers from the base element top surface and defines paths 20 and 22.

Each of the rear side elements 16 further includes a web 102 having an outside surface 104 and an inside surface 106. Each web further includes a front edge first portion 108 which extends upwardly from the base element top surface at a right angle thereto and is coplanar with the front edges 92 and 52 to further define the path 20. A front edge second portion 110 extends upwardly and rearwardly from the first portion 108 at a skewed angle thereto and a rounded corner 114 connects the second portion 110 to a top edge 116 that extends rearwardly from the front edge and is parallel to the base element top surface.

Each element 16 further includes a cap portion 120 that extends parallel to and spaced from the base element rear end 34. The cap portion includes an arcuate edge 122 and a linear edge 124, with the cap portion having two different inside surfaces 126 and 128 that are spaced from each other and are parallel to each other. The linear edge 124 is spaced outwardly from the surface 104 of the web, and a shoulder 130 connects the linear edge to the web. The linear edge 124 is closely adjacent to the base element side to be located between that side and the web. This spacing permits the ribbon 18' to be wound around a package of newspapers located in the receptacle, yet permits a user to place their fingers between the web and the ribbon to move the bundle out of the receptacle. The ribbon can be moved off of the side elements as the bundle is lifted out of the receptacle. This permits a bundle to be doubly tied for further securing that bundle.

The twine is located in the paths 20 and 22, and is wrapped about a bundle of newspapers located in the receptacle. The twine is then tied to tie the bundle up. The linear nature of the paths facilitates the movement of the twine about the bundle, and the rounded nature of the side element corners prevents the twine from being nicked or cut.

Figure 2:
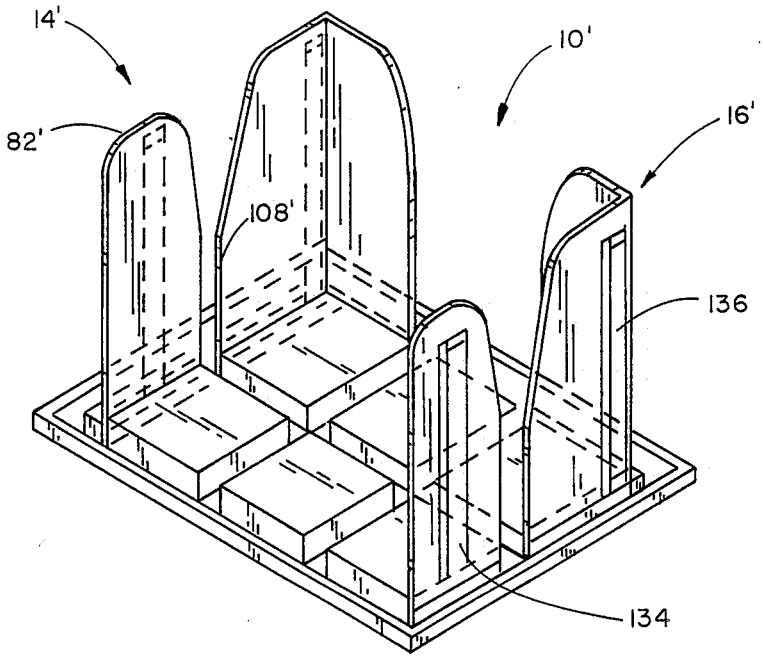
FIG. 2 is a perspective view of a second form of the newspaper collection and bundling receptacle of the present invention.
Figure 3:
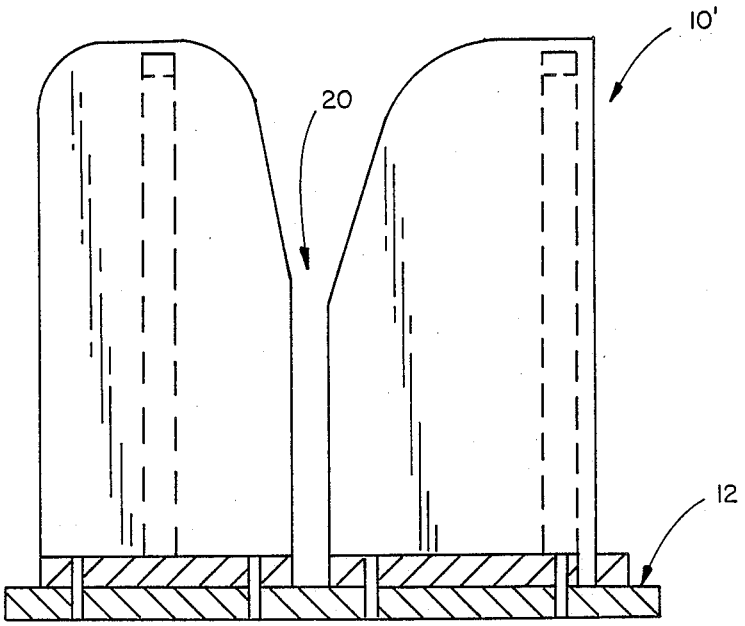
FIG. 3 is an end elevational view of the second form of the receptacle.
Figure 4:
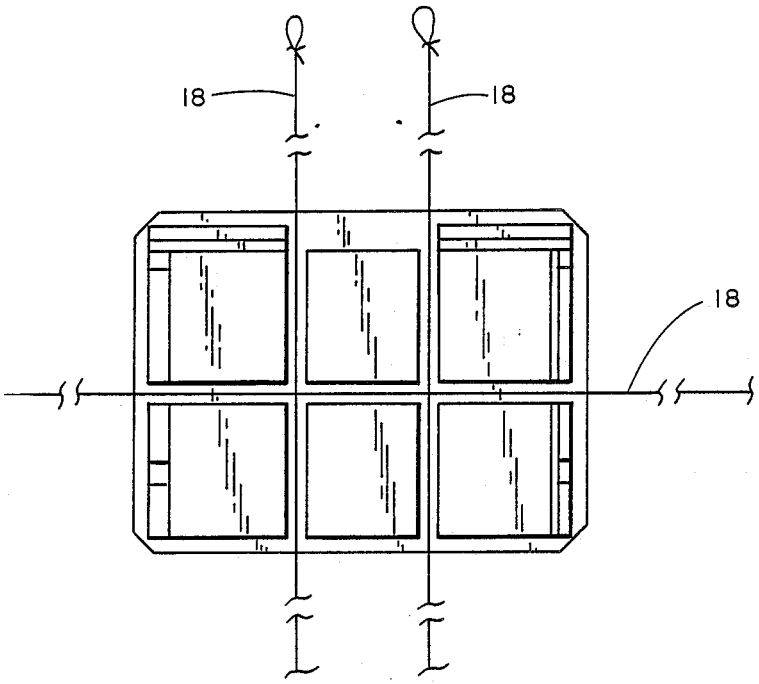
FIG. 4 is a top plan view of the second form of the receptacle showing the orthogonally arranged paths defined through the bottom of the receptacle and the twine and shuttle for pulling or pushing the twine through the paths after newspapers have been collected and stacked in the receptacle.

A second embodiment of the receptacle is shown in FIGS. 2 and 3 as receptacle 10'. The receptacle 10' is similar to the receptacle 10 except for the side elements. The receptacle 10' includes side elements 14' and 16'.

The front side elements 14' include an arcuate top edge 82', and a support element 134; whereas the support elements 16' include a support strip 136 in place of the caps 120. The front edges 110' of the rear side elements 16' are similar to the front edges 110, except that the first portion 108' is longer than the first portion 108 in receptacle 10. The front edges and rear edges of the support pads and the short legs are all collinear in receptacle 10'.

Figure 5:
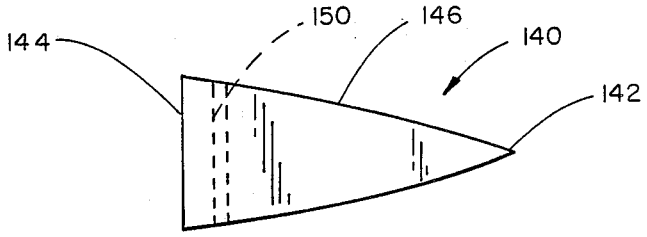
FIG. 5 is a side elevational view of a shuttle used to pull twine through the paths of the receptacle when newspapers are positioned in that receptacle.

A twine pulling shuttle 140 is shown in FIG. 5. The shuttle 140 is needle shaped to have a point 142 and a rear end 144. A curved surface 146 connects the rear end to the point and slopes towards that point so that the rear end has the largest outer dimension of the shuttle. A twine accommodating hole 150 is defined through the shuttle adjacent to the rear end, and the twine is attached to the shuttle by being threaded through this hole. The largest outside dimension of the shuttle is less than the thickness of the support pads so the shuttle can move freely through the paths 20 and 22 to pull twine through such paths.

If twine is to be placed about a bundle of newspapers that are already stored in the receptacle, the shuttle is used to thread the twine through the paths about the papers.

It is understood that while certain forms of the present invention have been illustrated and described herein, it is not to be limited to the specific forms of arrangements of parts described and shown.

I claim:

1. A receptacle for stacking and binding loose newspapers into a bundle comprising:

(A) a base element which includes
- (1) a bottom surface,
- (2) a planar top surface,
- (3) a front end, a rear end, a left side and a right side,
- (4) a longitudinal centerline extending between said front end and said rear end, said front and rear ends being parallel to each other, and said right and left sides being parallel to each other, and
- (5) a transverse centerline extending between said right side and said left side;

(B) a monolithic L-shaped right side front support element mounted on said base element and including
- (1) a short leg fixedly mounted on said base element top surface between said base element transverse centerline and said base element front end, and including
  - (a) a front edge located adjacent to and spaced from said base element front side, and extending parallel thereto,
  - (b) a rear edge located adjacent to and spaced from said base element transverse centerline
  - (c) an outside edge located adjacent to and spaced from said base element right side and being parallel thereto,
  - (d) an inside edge which is parallel to said outside edge,
  - (e) a planar top surface, and
  - (f) a thickness dimension measured between said short leg top surface and said base element top surface, and
- (2) a long leg extending upwardly from said short leg and including
  - (a) a front edge extending upwardly from said base element top surface at a right angle thereto,
  - (b) a top edge extending from said long leg front edge towards said base element rear end parallel to said base element top surface,
  - (c) a rear edge first portion portion extending from said top edge toward said base element top surface at a skewed angle thereto,
  - (d) a rounded corner connecting said top edge to said rear edge first portion,
  - (e) a rear edge second portion extending from said rear edge first portion to said base element top surface and being oriented at a right angle to said base element top surface,
  - (f) an inside surface, and
  - (g) an outside surface;

(c) a monolithic L-shaped left side front support element mounted on said base element and including
- (1) a short leg fixedly mounted on said base element top surface between said base element transverse centerline and said base element front end, and including
  - (a) a front edge located adjacent to and spaced from said base element front side, and extending parallel thereto,
  - (b) a rear edge located adjacent to and spaced from said base element transverse centerline,
  - (c) an outside edge located adjacent to and spaced from said base element left side and being parallel thereto,
  - (d) an inside edge which is parallel to said base element left side,
  - (e) a planar top surface which is co-planar with said right side support element short leg top surface, and
  - (f) a thickness dimension measured between said left side support element short leg top surface and said base element top surface, and
- (2) a long leg extending upwardly from said left side support element short leg and including
  - (a) a front edge extending upwardly from said base element top surface at a right angle thereto,
  - (b) a top edge extending from said left side support element long leg front edge towards said base element rear end parallel to said base element top surface,
  - (c) a rear edge first portion extending from said left side support element top edge toward said base element top surface at a skewed angle thereto,
  - (d) a rounded corner connecting said left side support element top edge to said left side support element rear edge first portion,
  - (e) a rear edge second portion extending from said left side support element rear edge first portion to said base element top surface and being oriented at a right angle to said base element top surface,
  - (f) an inside surface, and
  - (g) an outside surface;

(D) a monolithic right side rear support element mounted on said base element top surface between said base element transverse centerline and said base element rear end and including
- (1) a short leg fixed to said base element top surface and including
  - (a) an outside edge located adjacent to and spaced from said base element right side and extending parallel thereto, (b) an inside edge extending parallel to said base element right side and being collinear with said right side front support element short leg inside edge,
(c) a front edge located adjacent to and spaced from said base element transverse centerline and extending parallel thereto,
(d) a rear edge located adjacent to and spaced from said base element rear end and being parallel thereto, and
(e) a top planar surface which is coplanar with said right side front support element short leg top surface, (2) a web extending upwardly from said base element top surface at a right angle thereto and including
(a) a front edge first portion extending upwardly from said base element top surface at a right angle thereto and being spaced from said base element transverse centerline,
(b) a front edge second portion extending from said first portion towards said base element rear end at a skewed angle with respect to said base element top surface,
(c) a top edge extending from said web front edge second portion towards said base element rear end, and
(d) a rounded corner connecting said web top edge to said web front edge second portion, (3) a cap portion on said web portion and including
(a) a linear edge located adjacent to said base element right side,
(b) an arcuate edge,
(c) a top edge connecting said arcuate edge to said linear edge, and
(d) a shoulder between said linear edge and said web;

(E) a monolithic left side rear support element mounted on said base element top surface between said base element transverse centerline and said base element rear end and including
(1) a short leg fixed to said base element top surface and including
(a) an outside edge located adjacent to and spaced from said base element left side and extending parallel thereto,
(b) an inside edge extending parallel to said base element left side and being collinear with said left side front support element short leg inside edge,
(c) a front edge located adjacent to and spaced from said base element transverse centerline and extending parallel thereto,
(d) a rear edge located adjacent to and spaced from said base element rear end and being parallel thereto, and
(e) a top planar surface which is coplanar with said left side front support element short leg top surface, (2) a web extending upwardly from said base element top surface at a right angle thereto and including
(a) a front edge first portion extending upwardly from said base element top surface at a right angle thereto and being spaced from said base element transverse centerline,
(b) a front edge second portion extending from said left side rear support element first portion towards said base element rear end at a skewed angle with respect to said base element top surface,
(c) a top edge extending from said left side rear support element web front edge second portion towards said base element rear end, and
(d) a rounded corner connecting said left side rear support element web top edge to said left side rear support element web front edge second portion, and (3) a cap portion on said left side rear support element web portion and including
(a) a linear edge located adjacent to said base element left side,
(b) an arcuate edge,
(c) a top edge connecting said left side rear support element arcuate edge to said left side rear support element linear edge, and
(d) a shoulder between said left side rear support element linear edge and said left side rear support element web;

(F) a monolithic front support pad mounted on said base element top surface between said base element front end and said base element transverse centerline and including
(1) a front edge located adjacent to and spaced from said base element front end and extending parallel thereto,
(2) a rear edge located adjacent to and spaced from said base element transverse centerline and extending parallel thereto and being aligned with said front side support element short leg rear edges,
(3) a left side edge located adjacent to and spaced from said left side front support element short leg inside edge and being parallel thereto,
(4) a right side edge located adjacent to and spaced from said right side front support element short leg inside edge and being parallel thereto, and
(5) a planar top surface which is co-planar with said front support element short leg top surfaces; and (G) a monolithic rear support pad mounted on said base element top surface between said base element rear end and said base element transverse centerline and including
(1) a front edge located adjacent to and spaced from said base element transverse centerline and extending parallel thereto and being collinear with said rear support element short leg front edges,
(2) a rear edge located adjacent to and spaced from said base element rear end and extending parallel thereto,
(3) a left side edge located adjacent to and spaced from said left side rear support element short leg inside edge and being parallel thereto and being collinear with said front support pad left side edge,
(4) a right side edge located adjacent to and spaced from said right side rear support element short leg inside edge and being parallel thereto and being collinear with said front support pad right side edge, and
(5) a planar top surface which is co-planar with said front pad top surface.

2. The receptacle defined in claim 1 further including a shuttle element which includes a pointed end, a circular rear end, a tapered body connecting said rear end to said pointed end, and a twine accommodating hole defined through said body adjacent to shuttle element said rear end.

3. The receptacle defined in claim 2 wherein said shuttle element has an outer dimension adjacent to said rear end which is less than said front support element short leg thicknesses.

* * * * *